US010215003B2

(12) United States Patent
Devarajan et al.

(10) Patent No.: US 10,215,003 B2
(45) Date of Patent: Feb. 26, 2019

(54) APPARATUS FOR CARRYING CHEMICAL TRACERS ON DOWNHOLE TUBULARS, WELLSCREENS, AND THE LIKE

(71) Applicant: Weatherford Technology Holdings, LLC, Houston, TX (US)

(72) Inventors: Kannan Devarajan, Dubai (AE); Pankaj Khobragade, Abu Dhabi (AE); Prakash Fernandes, Abu Dhabi (AE)

(73) Assignee: Weatherford Technology Holdings, LLC, Houston, TX (US)

( * ) Notice: Subject to any disclaimer, the term of this patent is extended or adjusted under 35 U.S.C. 154(b) by 205 days.

(21) Appl. No.: 15/078,812

(22) Filed: Mar. 23, 2016

(65) Prior Publication Data

US 2016/0281476 A1 Sep. 29, 2016

Related U.S. Application Data

(60) Provisional application No. 62/137,404, filed on Mar. 24, 2015.

(51) Int. Cl.

| | |
|---|---|
| ***E21B 43/08*** | (2006.01) |
| ***E21B 47/10*** | (2012.01) |
| ***E21B 27/00*** | (2006.01) |

(52) U.S. Cl.

CPC ..... *E21B 43/084* (2013.01); *E21B 27/00* (2013.01); *E21B 43/08* (2013.01); *E21B 47/1015* (2013.01)

(58) Field of Classification Search

CPC ..... E21B 43/084

See application file for complete search history.

(56) References Cited

U.S. PATENT DOCUMENTS 2,877,852 A * 3/1959 Bashara ..... E21B 43/08 166/230

5,543,617 A 8/1996 Roscoe (Continued)

FOREIGN PATENT DOCUMENTS

WO 2011/005988 A1 1/2011

WO 2011153636 A1 12/2011

(Continued)

OTHER PUBLICATIONS

Williams, B.; "Intelligent Inflow Tracers Obtain Information With Less Risk, Cost"; Oct. 1, 2014; Journal of Petroleum Technology; http://www.spe.org/jpt/article/4333-young-technology-showcase-11/; pp. 1-14.

(Continued)

*Primary Examiner* — Shane Bomar

(74) *Attorney, Agent, or Firm* — Blank Rome, LLP

(57) ABSTRACT

An access device installs on a wellscreen joint during manufacture and allows access to one or more spaces or layers where tracer elements can be installed adjacent the joint's screen jacket (i.e., internal and/or external to the screen jacket). Portion of the access device is removable to allow installation of the tracer elements after the joint has been manufactured. With the tracer elements installed, the access device can be reassembled and locked in place. Any various mechanism can allow the access device to be partially removed, the tracer elements to be installed, and the access device to be reassembled in place. For example, an end ring holding the jacket on the basepipe can have at least one channel communicating with a space or layer for insertion of the tracer elements. A removable cover can be removed to allow access to the at least one channel and can be reattached for the wellscreen to be used downhole.

20 Claims, 12 Drawing Sheets

(56) References Cited

U.S. PATENT DOCUMENTS

| | | | | |
|---|---|---|---|---|
| 5,711,900 | A | 1/1998 | Jones | |
| 5,937,944 | A * | 8/1999 | Simone | B01D 29/111 166/230 |
| 6,001,280 | A | 12/1999 | Jones | |
| 6,016,191 | A | 1/2000 | Ramos | |
| 6,075,611 | A | 6/2000 | Dussan, V | |
| 6,349,766 | B1 | 2/2002 | Bussear | |
| 6,645,769 | B2 | 11/2003 | Tayebi | |
| 6,672,385 | B2 | 1/2004 | Kilaas | |
| 6,850,317 | B2 | 2/2005 | Mullins | |
| 6,915,848 | B2 | 7/2005 | Thomeer | |
| 7,560,690 | B2 | 7/2009 | Stray | |
| 8,136,594 | B2 | 3/2012 | Streich | |
| 8,162,054 | B2 | 4/2012 | Shultz | |
| 8,342,244 | B2 | 1/2013 | Streich | |
| 8,567,497 | B2 | 10/2013 | Moen | |
| 8,567,498 | B2 | 10/2013 | Scott | |
| 8,603,827 | B2 | 12/2013 | Zahlsen | |
| 8,640,773 | B2 | 2/2014 | Hewitt | |
| 8,949,029 | B2 | 2/2015 | Nyhavn | |
| 2007/0114171 | A1* | 5/2007 | Chen | B01D 29/15 210/489 |
| 2009/0025470 | A1 | 1/2009 | Green | |
| 2010/0006750 | A1 | 1/2010 | Zahlsen | |
| 2011/0024111 | A1* | 2/2011 | Moen | E21B 43/08 166/278 |
| 2012/0118564 | A1* | 5/2012 | Gomes | E21B 43/08 166/250.12 |
| 2012/0325464 | A1 | 12/2012 | Kilaas | |
| 2013/0020088 | A1 | 1/2013 | Dyer | |
| 2013/0245948 | A1* | 9/2013 | Nyhavn | E21B 27/02 702/6 |
| 2013/0319664 | A1 | 12/2013 | McNamee | |
| 2014/0101918 | A1 | 4/2014 | Woiceshyn | |
| 2014/0262322 | A1 | 9/2014 | Yeh et al. | |
| 2015/0041121 | A1* | 2/2015 | Hunt | E21B 43/04 166/250.12 |
| 2015/0060059 | A1 | 3/2015 | Langlais et al. | |
| 2016/0096240 | A1* | 4/2016 | Koli | B23K 20/02 228/175 |

FOREIGN PATENT DOCUMENTS

| | | | |
|---|---|---|---|
| WO | 2012057634 | A1 | 5/2012 |
| WO | 2012/135587 | A2 | 10/2012 |
| WO | 2012153132 | A1 | 11/2012 |
| WO | 2012153133 | A1 | 11/2012 |
| WO | 2013083966 | A2 | 6/2013 |
| WO | 2013102766 | A1 | 7/2013 |
| WO | 2013144657 | A1 | 10/2013 |
| WO | 2013158682 | A2 | 10/2013 |
| WO | 2015/065403 | A1 | 5/2015 |

OTHER PUBLICATIONS

Carvalho, V.; "The Evolution of Production"; Oilfield Technology; Feb. 2015; pp. 36-42.

Weatherford, "Sand Screen Selector: Open Hole"; Brochure, Copyrighted 2010-2012; pp. 1-7.

RESMAN; "How It Works—RESMAN Intelligent Tracer technology accurately quantifies zonal inflow contribution and detects the location of water breakthrough"; obtained from http://www.resman.no./; Copyrighted 2015; pp. 1-4.

RESMAN; Wireless Reservoir Surveillance; "Quantifying Reservoir Inflow Contribution With RESMAN's Flush Out Model"; Technical Bulletin 2—The Flush Out Model; obtained from http://www.resman.no/ on Feb. 27, 2015; pp. 1-2.

RESMAN; Wireless Reservoir Surveillance; "Quantifying Reservoir Inflow Contribution With RESMAN's Arrival Time Model"; Technical Bulletin 3—The Arrival Time Model; obtained from www.resman.no on Feb. 27, 2015; pp. 1-2.

RESMAN; Wireless Reservoir Surveillance; "How RESMAN Delivers Value: From Design to Answers"; Technical Bulletin 4—The RESMAN Process; obtained from http://www.resman.no/ on Feb. 27, 2015; pp. 1-2.

Edmundson, H.; "A Revolution in Reservoir Surveillance for Subsea Production Environments"; Reservoir Management; Scandinavian Oil-Gas Magazine; No. 7/8; dated 2013; pp. 61-63.

Brough, B.; "Intelligent Tracers Quantify In-Flow Characteristics in Multi-Zone Horizontal Wells"; Reservoir Management; World Oil; dated Oct. 2013; p. 1.

Int'l Search Report and Written Opinion in counterpart PCT Appl. PCT/US2016/023809, dated Sep. 1, 2016, 17-pgs.

* cited by examiner (Background)

APPARATUS FOR CARRYING CHEMICAL TRACERS ON DOWNHOLE TUBULARS, WELLSCREENS, AND THE LIKE

BACKGROUND OF THE DISCLOSURE

Chemical tracers have been used in the oil industry to identify treatment fluid paths and produced fluids downhole. A common method of locating the chemical tracers in the wellbore is to use tracer elements on wellscreens. The wellscreens are then deployed in the wellbore to locate the wellscreens with the chemical tracers in the desired well locations. For example, chemical tracers have been placed on screen joints at the sand face to gather data on the produced fluids.

As background, a completion system 10 in FIG. 1A has completion screen joints 50 deployed on a completion string 14 in a borehole 12. Typically, these screen joints 50 are used for horizontal and deviated boreholes passing in an unconsolidated formation, and packers 16 or other isolation elements can be used between the various joints 50. During production, fluid produced from the borehole 12 directs through the screen joints 50 and up the completion string 14 to the surface rig 18. The screen joints 50 having screen jackets 60 that keep out fines and other particulates in the produced fluid. In this way, the screen joints 50 can mitigate damage to components, mud caking in the completion system 10, and other problems associated with fines and particulates present in the produced fluid.

In addition to providing sand control, one or more of the screen joints 50 can include tracer material for marking produced or injected fluid in the wellbore. The tracer material can be used to mark any type of produced or injected fluids, and the tracer material can have various types of chemical compositions and can come in many different forms. For example, the tracer material can have the form of a stick, beads, powder, or paste that can be installed into a layer or space by force, by gravity, with air flow, etc. For example, the tracer material can come in the form of elements such as long strips that slip adjacent the screen jacket 60.

The tracer material can be radioactive or non-radioactive. For example, the tracer material can be perfluorinated hydrocarbons encapsulated in polymer particles or the like that are sensitive to water or hydrocarbon. In this way, the polymer encapsulation can break and release the tracer material. The tracer material can also be an oligonucleotide with special functional groups and can be fluorescent, phosphorescent, or the like or can include magnetic particles or fluids, colored particles, biological material, or microorganisms. Release of the tracer material can be triggered by oil, water, gas, or a combination thereof. The type and amount of tracer material can be varied by the type of fluid and/or gas that triggers the release, by the position of the tracer material in the completion, and by the geometric position around the wellbore, and these characteristics can be varied from well to well.

In use, the tracer material associated with the screen joint 50 is placed adjacent a reservoir section of a well so that the flow of produced fluids can release the tracer. The placement is configured so that operators at the surface can associate the produced fluids to the sections of the wellbore and reservoir from which they are produced. With the tracer released in the produced fluids, various detection techniques can be used to detect the tracer in the produced fluid, and the particular detection technique used at surface can depend on the type of tracer employed. For example, the detection techniques can use optical, spectroscopic, chromatographic, acoustic, magnetic, capacitive, microwave, or any combination of these techniques, and the detection can involve manual or automatic sampling, monitoring, etc. of the produced fluids.

Chemical tracers have been used on screens in different ways. In general, typical wellscreen designs require that the tracer elements be incorporated in the screen during the screen manufacturing process, which increases costs and limits which type of chemical tracer can be used. For example, the chemical tracers can be incorporated as solid elements during the manufacturing process of the screen. The tracer elements are often placed between a sand retention layer and a basepipe of the wellscreen at a manufacturing facility. An example screen joint 50 with tracer elements is depicted in FIG. 1B, such as disclosed in U.S. Pat. No. 8,949,029. Also, an example form of manufacture for a screen joint with tracer elements is disclosed in US 2014/0101918.

For wire wrap screens, the tracer is installed between the wrap wire and the basepipe of the screen between the axial ribs of the wire wrap jacket. For a metal mesh screen, the tracer can be installed underneath the drainage layer if it is a component of the screen design or adhered to the metal mesh sand control layer directly in flat narrow panels before the protective shroud is placed over as a protective jacket. Sometimes, tracers are inserted as round rods through the holes in the perforated shroud between the metal mesh layer and the protective shroud. This is difficult due to the limited space between the shroud and the metal mesh.

In these assembly techniques, the tracer is installed before the end rings are welded to the jackets of the wellscreen. Depending on metallurgies, some processes such as welding and post-weld heat treatment have to be considered. The tracer materials can be heat sensitive and may be exposed to welding/heat treatment operations during manufacturing that can damage the tracer materials.

In other manufacturing techniques, tracer can be injected into the assembled screen in a liquid form where it is allowed to cure or set into the screen. For example, manufacturers can inject a gel-like substance between the shroud and the metal mesh of a wellscreen.

Rather than using tracer elements in the gap between a screen and a basepipe, tracer elements can be held inside a basepipe using an insert. An example arrangement of this is depicted in FIG. 1C.

Because these techniques require specific pre- and post-assembly steps, the ability to configure a screen with a tracer in the field is limited. For instance, being manufactured at the facility, the installation of the tracer occurs far from the rig location and long before the screen is deployed. The tracer material is fixed in place and cannot be changed. This reduces the opportunity to make any changes to the well design program. Another problem is that current screen constructions might limit the amount of tracer that can be installed on the screen.

Therefore, there is a need for a way to install a tracer in a wellscreen that is more conducive to being performed in the field. The subject matter of the present disclosure is directed to overcoming, or at least reducing the effects of, one or more of the problems set forth above.

SUMMARY OF THE DISCLOSURE

An access device installs on a wellscreen joint during manufacture and allows access to one or more spaces or layers where tracer elements can be installed adjacent the joint's screen jacket (i.e., internal and/or external to the screen jacket). Portion of the access device is removable to allow installation of the tracer elements T after the joint has been manufactured. With the tracer elements installed, the access device can be reassembled and locked in place using a locking mechanism, such as a lock nut, J-slot, crimping, channel lock, or other type of locking mechanism. Any of these various mechanism can allow the access device to be partially removed, the tracer elements to be installed, and the access device to be reassembled in place.

In one embodiment, the access device has an end ring, a housing or cover, an attachment ring, and a locking ring. The end ring fixes to the basepipe to hold the jacket, and the cover is removable to provide access to spaces or layers for insertion of the tracer elements. The attachment ring provides part of the locking mechanism, and the locking ring completes the locking mechanism. Pins or set screws can also be used as part of the locking mechanism.

In another embodiment, the access device has an external carrier shroud that forms a tracer carrier space external to the screen jacket without diminishing mechanical strength of the screen and maintaining acceptable outer dimensions. To provide the carrier space external to the screen jacket, the shroud can have axial ribs or spacers disposed along its inner surface to create channels for insertion of the tracer elements after the screen has been manufactured.

The spacers can run axially along the length of the shroud to create annular channels to carry the tracer elements. The spacers can be rolled into the shroud or mechanically installed on the shroud. The number of channels can be increased and the channel size can be modified to be wider/narrower or taller/shallower to address the needs for a particular amount of tracer material and any diameter restrictions.

The shroud can be composed of plate metal or pipe of a specified wall thickness that is punched or drilled with holes to provide a specified open area. The open area of the shroud can be increased or decreased by changing the hole shape, size, and quantity per area. For example, the shroud's open area can be modified to address the need for more or less open area, to direct flow from the wellbore through the tracer elements to the screen, and to provide mechanical strength for the operating conditions. To form the shroud, the plate metal with the perforated openings is rolled circumferentially to a specified diameter and then welded together spirally or longitudinally to create a tube or a seamless tube can be used.

In the embodiments of the access device, the tracer elements for the screen jacket of the joint can be added at the end of the assembly process or long after assembly in a field operations base. In this way, the amount of tracer material that can be installed or located on the wellscreen joint can be configured as needed. For example, the access device allows operators to change the isotope formulation for the tracer material on location. Additionally, even though a given wellscreen joint may not be predetermined to hold tracer material when run downhole, the given joint can allow for tracer elements to be inserted on the fly as needed during field operations to accommodate changes in well design.

The basic design and performance of the screen jacket, however, is expected to remain unchanged. The open area of the sand retention layer being metal mesh or wire wrap is expected to remain the same. The disclosed access device removes the tracer installation process from the process of fabricating the wellscreen and removes the risk of damaging tracer elements during screen fabrication.

According to the present disclosure, a downhole assembly positions in a borehole for dispensing tracer material and includes a basepipe (e.g., tubular, casing, pipe, or the like), a filter, an end ring, and a cover ring. The filter is disposed about the basepipe and filtering fluid communication that can then pass through perforations in the basepipe.

The end ring is deposed on the basepipe and holds an end of the filter to the basepipe. The cover ring is disposed in place relative to the end ring. The cover ring is removable and provides access to at least one space adjacent the filter for insertion of the tracer material.

For example, the end ring defines at least one channel communicating adjacent the filter. An attachment ring is affixed to the basepipe, and the cover ring is removably disposed between the end ring and the attachment ring.

The filter can have ribs supporting the filter on the basepipe and can define a drainage layer between the filter and the basepipe. In this case, the at least one channel of the end ring can communicate with the drainage layer for the insertion of the tracer material.

The cover ring can have a first end abutting the end ring and can have a second end attaching to the attachment ring. Also, a lock ring can abut the second end of the cover ring and can affix to the attachment ring by threading. Moreover, the first and second ends of the cover ring can seal respectively with the end ring and the attachment ring.

An external shroud can be disposed about the filter and can define at least one space between the shroud and the filter. To produce the space between the shroud and the filter, the external shroud can have at least one spacer disposed on an inner surface thereof and contacting a portion of the filter to form the at least one space.

The external shroud can slip over the end ring and position on the filter so the cover ring can hold a portion of the external shroud on the filter. Alternatively, a portion of the external shroud can be held by the end ring. In this case, at least one channel of the end ring can communicate with the at least one space for the insertion of the tracer material.

According to a method of inserting tracer material in a downhole assembly after assemblage, access can be provided to at least one channel in the end ring for insertion of the tracer material adjacent the filter by removing a cover abutting between the end ring and the attachment ring disposed on the basepipe. The tracer material inserts through the at least one channel and adjacent the filter. The cover replaces between the end ring and the attachment ring and affixes in place at the attachment ring.

According to the present disclosure, a downhole assembly positions in a borehole for dispensing tracer material (i.e., into the borehole, into fluid flow into the assembly, or both). The assembly includes a basepipe (e.g., tubular, casing, pipe, or the like), a filter, and end ring, an external shroud, and a cover ring. The external shroud slips over the end ring and positions on the filter disposed about the basepipe. The external shroud defines a space about the filter for holding the trace material. The cover ring attaches to the end ring. The cover ring is removable and provides access to the space for insertion of the tracer material adjacent the filter.

According to the present disclosure, a downhole assembly for dispensing tracer material (i.e., into the borehole, into fluid flow into the assembly, or both). The assembly includes a basepipe, an internal shroud, and fixtures. The internal shroud is disposed inside a through-bore of the basepipe and defining an annular space therewith. The shroud holds the tracer material in the annular space and permitting fluid communication between the annular space and the through-bore in the basepipe and/or the through-bore in the shroud. The fixtures are disposed on the ends of the internal shroud and hold the internal shroud in the basepipe's through-bore.

The fixtures can include internal retainer rings engaged on the ends of the internal shroud and engaged internal in the first through-bore of the basepipe. The retainer rings can define central passages permitting fluid communication between the through-bores of the shroud and basepipe. The retainer rings can define peripheral passages permitting fluid communication between the basepipe's through-bore and the annular space.

The fixtures can include external couplings affixed on the ends of the basepipe for connecting sections of basepipe together. The couplings can engage the ends of the shroud and can holding the internal shroud inside the basepipe's through-bore.

The foregoing summary is not intended to summarize each potential embodiment or every aspect of the present disclosure.

DETAILED DESCRIPTION OF THE DISCLOSURE

Figure 1A:
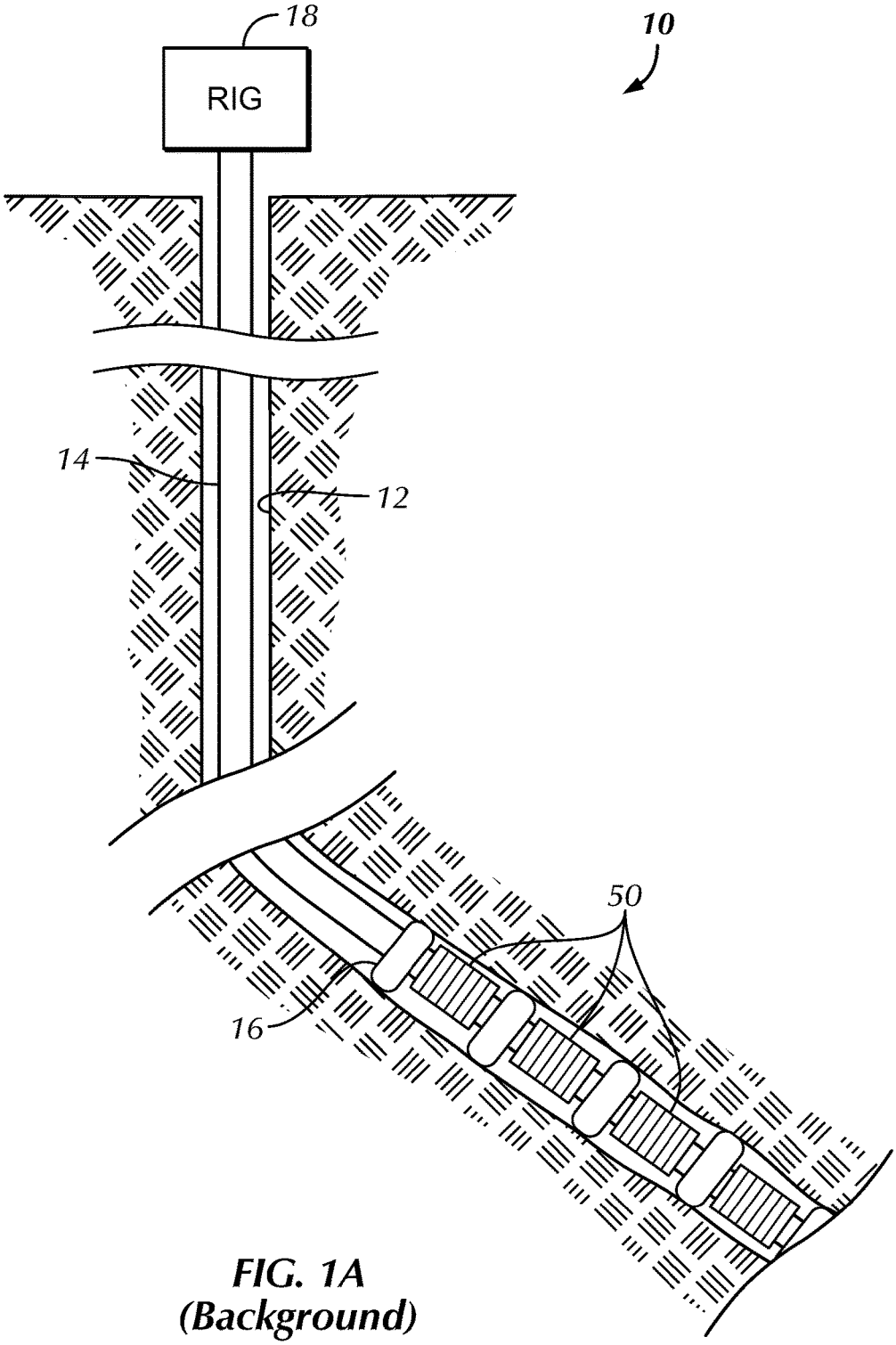
FIG. 1A illustrates a completion system as background to the present disclosure.
Figure 1B:
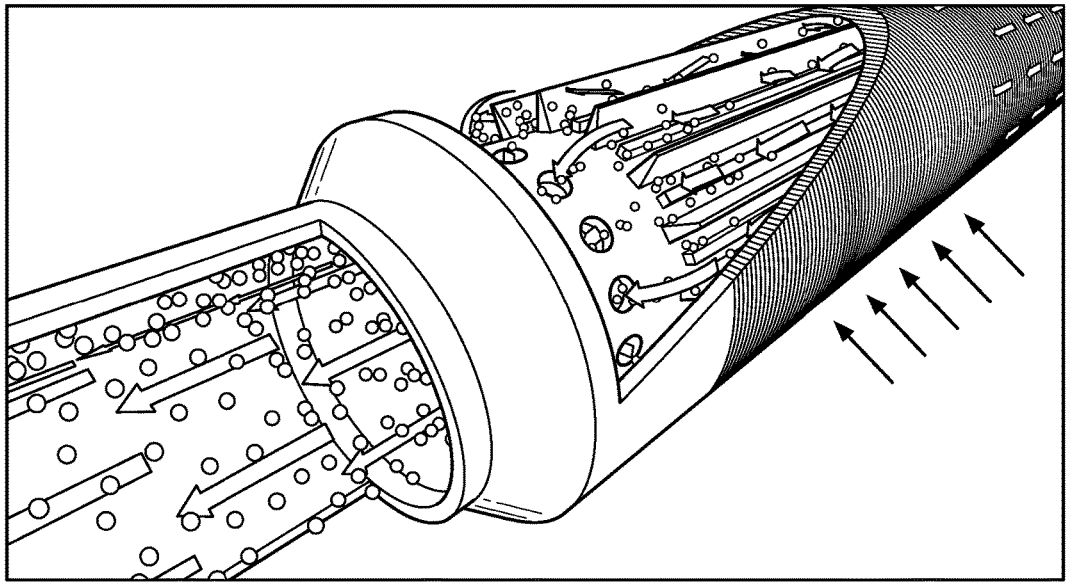
Fig. 1B (Prior Art)
FIG. 1B illustrates a screen joint according to the prior art for holding tracer elements.
Figure 1C:
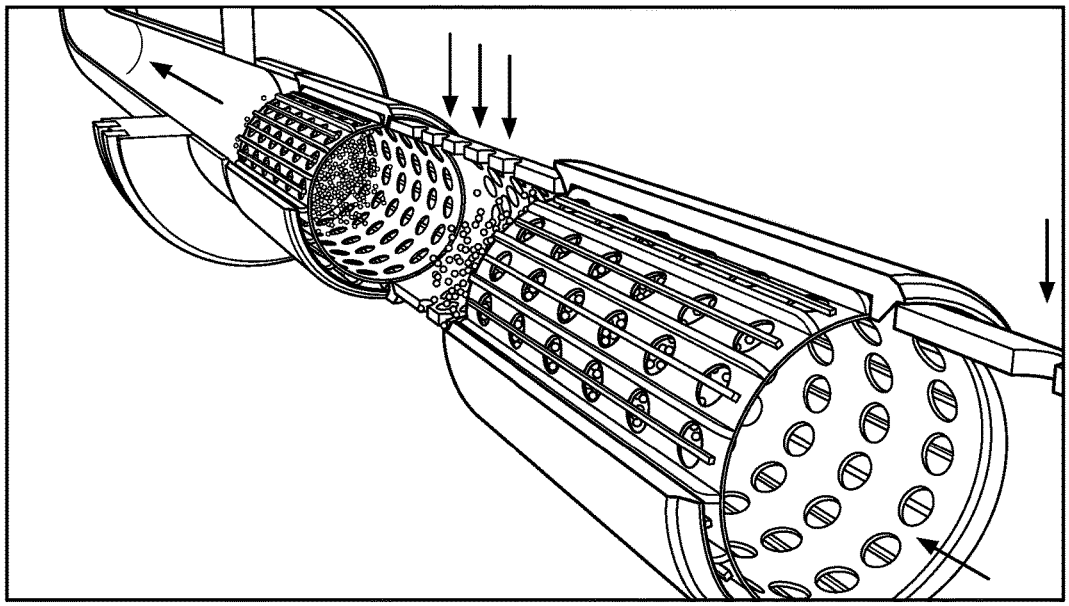
Fig. 1C (Prior Art)
FIG. 1C illustrates another joint according to the prior art for holding tracer elements.

Embodiments of the present disclosure can be used with joints without screen or joints with screens. For example, embodiments of the present disclosure can be used with completion screen joints in a completion, such as generally depicted in FIG. 1, although other arrangements can be used.

Figure 2A:
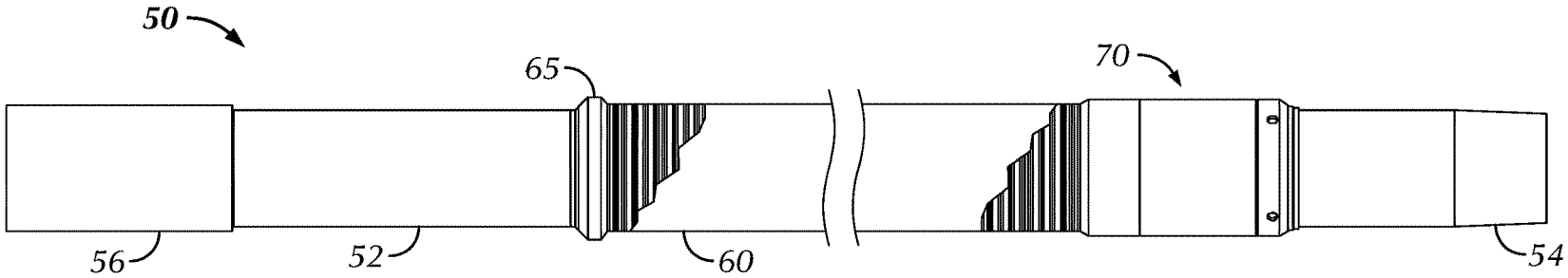
FIGS. 2A-2B illustrate a wellscreen of the completion system for installing tracer material in the field in a side view and a partial cross-sectional view.
Figure 2B:
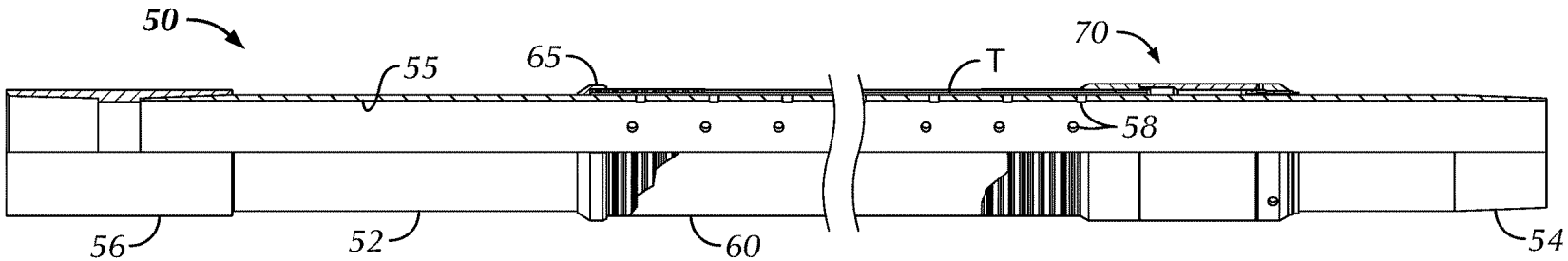
Figure 2C:
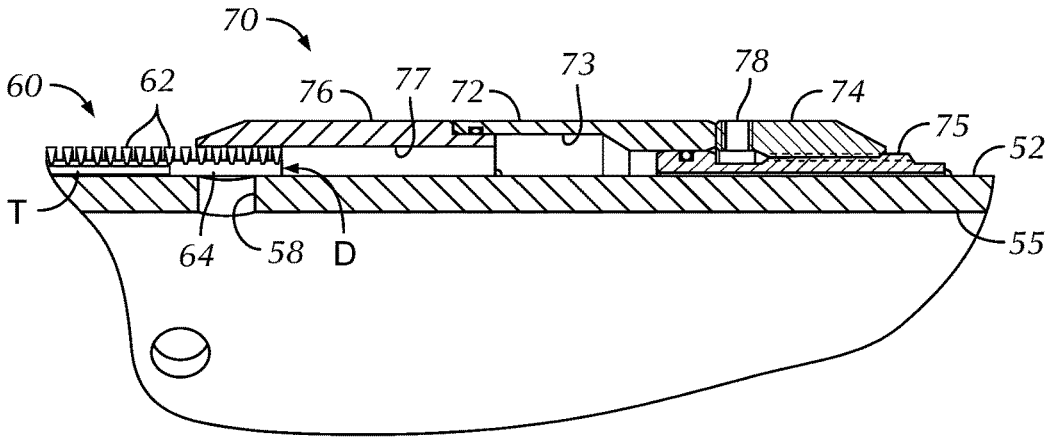
FIG. 2C illustrates a detailed view of an access device for the wellscreen of FIGS. 2A-2B.

Turning now to FIGS. 2A-2C, a completion screen joint 50 is shown in a side view, a partial side cross-sectional view, and a detailed view, showing placement of tracer elements T. The screen joint 50 has a basepipe 52 with a sand control jacket 60 and an access device 70 disposed thereon. The basepipe 52 defines a through-bore 55 and has a coupling crossover 56 at one end for connecting to another joint or the like. The other end 54 can connect to a crossover or coupling (not shown) of another joint on the completion string. Inside the through-bore 55, the basepipe 52 defines pipe ports 58, which can be defined along the length of the basepipe 52 where the screen jacket 60 is located. Additionally, the ports 58 may be located where the access device 70 is disposed, although this is not strictly necessary.

The sand control jacket 60 is disposed around the outside of the basepipe 52. As shown, the sand control jacket 60 can be a wire-wrapped screen having rods or ribs 64 arranged longitudinally along the basepipe 52 with windings of wire 62 wrapped thereabout to form various slots. Fluid from the surrounding borehole annulus can pass through the annular slots and can travel into the drainage layer D between the sand control jacket 60 and the basepipe 52. Although the jacket 60 is shown as a wire-wrapped screen, any suitable type of screen or filter may be used.

One end of the jacket 60 is held to the basepipe 52 with an end ring 65, which can be welded to the basepipe 52 and block fluid flow from the jacket 60. The other end of the jacket 60 is held by the access device 70. Although an end ring 65 is shown, the joint 50 may have another access device 70. Alternatively, an inflow control device having configurable nozzles can be used, in which case any perforations 58 in the basepipe 52 would be limited to the area under the inflow control device.

As best shown in FIG. 2C, the access device 70 disposed at one end of the jacket 60 has a removable cover 72, a lock nut 74, and an attachment ring 75 disposed about the basepipe 52 adjacent an end ring 76 for the jacket 60. During manufacture, the jacket 60 is formed on the basepipe 52. Then, to secure the jacket 60, the end ring 76 is shrunk fit partially over an end of the jacket 60 and is welded to the basepipe 52 around the outer edge or held with wire locks (not shown).

As shown, the end ring 76 defines one or more access gaps or slots 77 that communicate under the screen's wire 62 into the drainage layer D. To seal off these slots 77 during manufacture, the attachment ring 75 is welded to the basepipe 52 a set distance from the end ring 76. The removable cover 72 with its internal dimension 73 slips over the end of the basepipe 52 and the attachment ring 75 and abuts at one end to the end ring 76 and abuts at the other end to the attachment ring 75. O-rings or other seals can be used to seal these abutments. To then fix the cover 72, the lock nut 74 is slid over the basepipe 52 and then threaded to the attachment ring 75. To complete the fixture, one or more lock fasteners 78 or the like can thread through the lock nut 74 and into the attachment ring 75.

During the manufacture process, any post welding heat treatment can be performed as needed when components such as the end ring 76 and attachment rings 75 are affixed to the basepipe 52. As already noted, tracer material may be damaged from any post weld heat treatment during manufacture. In this case, the heat treatment will not hurt any tracer elements T because they do not need to be (and preferably are not) installed yet.

Now that the joint 50 is manufactured, it can be handled, shipped, and stored as needed. At any point during post-manufacture and even in the field, operators can configure the joint 50 to accept tracer material. To do this, operators can remove the lock nut 74 from the attachment ring 75, first removing any fasteners 78 and unthreading the nut 74. The cover 72 can then slide away from the end ring 76 with the cover's inner dimension 73 passing over the attachment ring 74. At this point, access to the drainage layer D between the screen's wire 62 and the basepipe 52 can be obtained through the one or more slots 77 in the end ring 76.

Operators then insert the desired tracer material into the layer D. In general, the tracer material can be water and/or oil sensitive and can have a particular detectable signature at the surface to coordinate the location of the produced fluids with the known placement of the particular tracer material. The tracer material can be in the form of elements T that are typically a rigid, plastic-like material. They may be rectangular in cross-section being about 8.5-mm wide, 3.5-mm tall, and 1-m long. The screen jacket 60 can be several feet in length (e.g., 20-ft), and operators can fill the drainage layer D with a number of such tracer elements T. For example, hundreds of elements T can be inserted into the screen's drainage layer D. More or less tracer elements T can be added to increase the amount of time that the tracer material can be detected and used. In any event, the particulars of the use and configuration of the tracer material and elements T are dictated by the reservoir engineers.

With the tracer elements T installed, operators then reassemble the access device 70 so the joint 50 can be deployed downhole. Repeating assembly steps, operators slip the cover 72 to abut between the end ring 76 and the attachment ring 75 and then affix the lock nut 74 and fasteners 78. As can be seen, the disclosed access device 70 allows operators to insert tracer elements T adjacent the screen jacket 60 while in the field or during post manufacture without having to install the elements T during the manufacture process.

Figure 3:
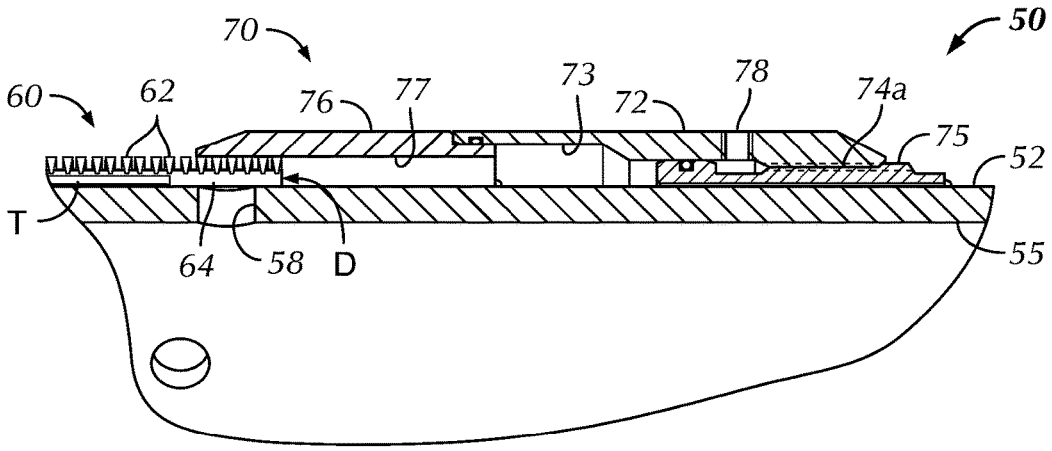
FIG. 3 illustrates a detailed view of another access device for the wellscreen.

FIG. 3 illustrates a detailed view of another access device 70 for the wellscreen. In contrast to the previous embodiment, the access device 70 incorporates a lock nut end 74*a* to the cover 72 instead of requiring a separate component. Again, to secure the jacket 60, the end ring 76 is shrunk fit partially over an end of the jacket 60 and is welded to the basepipe 52 around the outer edge.

To seal off the end ring's slots 77 during manufacture, the attachment ring 75 is welded to the basepipe 52 a set distance from the end ring 76. The removable cover 72 with its internal dimension 73 slips over the end of the basepipe 52 and the attachment ring 75 and abuts at one end to the end ring 76. At the other end, the removable cover 72 has internal threading at its lock nut end 74*a* that threads to the attachment ring 75. To then fix the cover 72, one or more lock fasteners 78 or the like can thread through the cover's end 74*a* and into the attachment ring 75.

Figure 4:
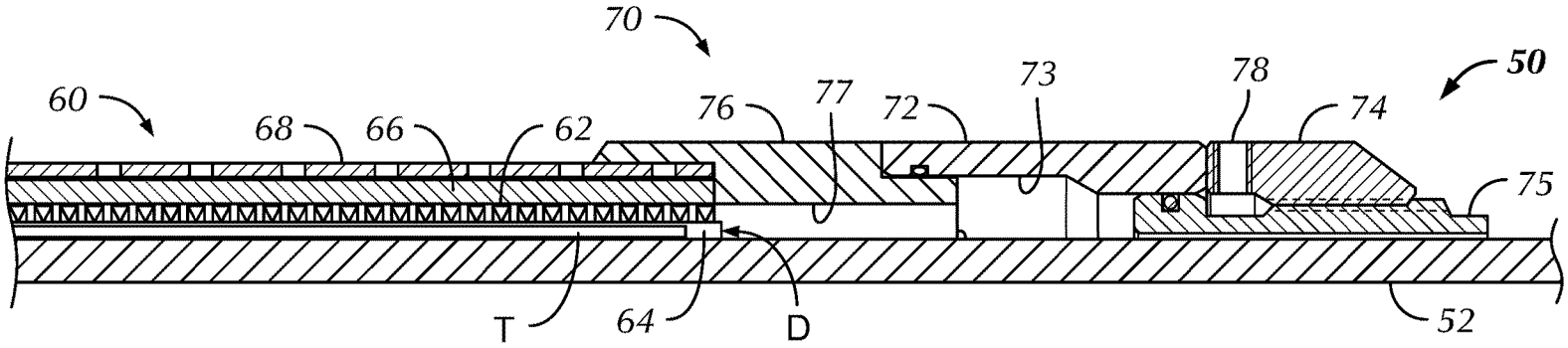
FIG. 4 illustrates another wellscreen of the present disclosure for installing tracer material in the field or post-manufacture.

Previous embodiments disclosed the jacket 60 being a wire-wrapped screen. Other types of screens can be used. As shown in FIG. 4, for example, a mesh screen or filter can benefit from the disclosed access device 70.

The jacket 60 as a mesh screen includes rods 64, wrapped wire 62, mesh 66, and a perforated shroud 68. Similar to the previous arrangement, the end ring 76 fits partially on the end of the jacket 60 over the shroud 68, mesh 66, wire 62, and rods 64. The end ring 76 then welds to the basepipe 52, and the other components of the access device 70 are assembled as before. In this way, tracer elements T can be inserted during post manufacture or in the field in the drainage layer D of the jacket 60.

Figure 5B:
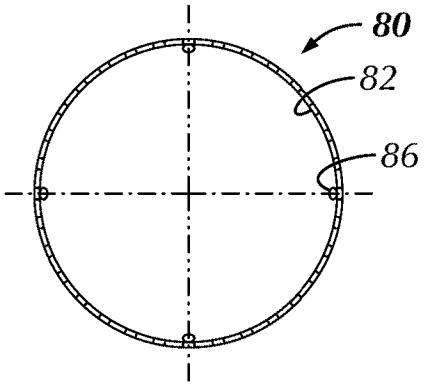
FIGS. 5A-5B illustrates a shroud of yet another access device for a wellscreen.
Figure 5A:
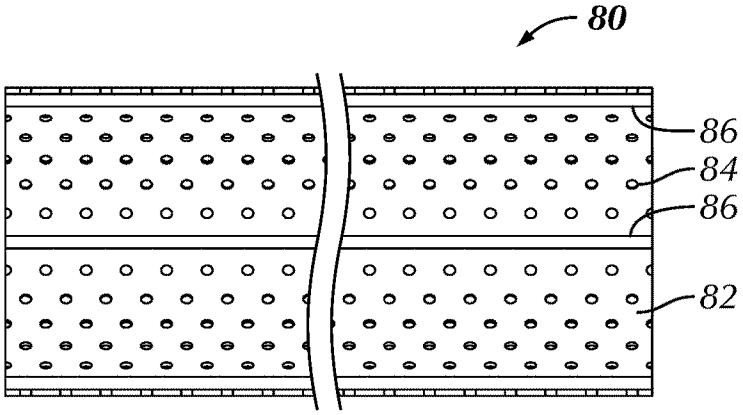

In previous embodiments, the tracer elements T have been inserted in the drainage layer D between the jacket 60 and the basepipe 52. Other locations can also receive tracer elements. As shown in FIGS. 5A-5B, a shroud 80 for an access device 70 of the present disclosure is shown in side cross-sectional and end views. The shroud 80 defines a plurality of perforations 84 for flow through the shroud 80. To space the shroud 80 from other components of a wellscreen, the shroud 80 has a number of spacers 86 disposed about its inner circumference 82.

Figure 6A:
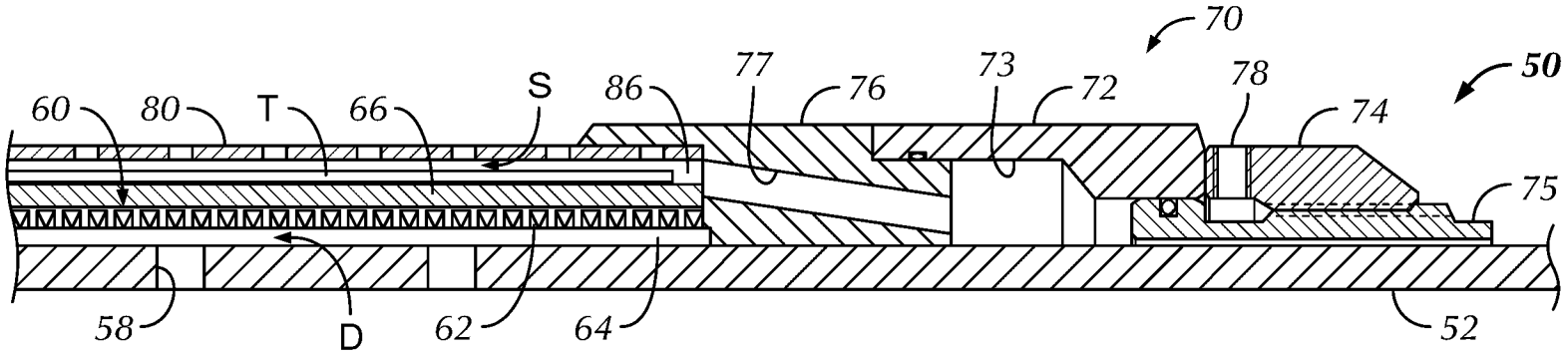
FIG. 6A illustrates a wellscreen of the present disclosure having the shroud for installing tracer material in the field or post-manufacture.

The shroud 80 can be used with wellscreens for insertion and storage of tracer elements T. As shown in FIG. 6A, for example, a wellscreen joint 50 allows tracer elements T to be installed during post-manufacture or in the field between the outer shroud 80 and the screen jacket 60. Again, the jacket 60 can be a mesh jacket as noted previous, but any other filter can be used. In any event, the jacket 60 is assembled on the basepipe 52 as before.

The disclosed shroud 80 with spacers 86 is installed around the outside of the jacket 60. Then, an end ring 76 shrink fits partially over an end of the shroud 80 and jacket 60 and is welded to the basepipe 52. At this point, other components of the access device 70 can be assembled. Here, the attachment ring 75 is welded to the basepipe 52 a set distance from the end ring 76. The removable cover 72 with its internal dimension 73 slips over the end of the basepipe 52 and the attachment ring 75 and abuts at one end to the end ring 76 and at the other end to the attachment ring 75. O-rings or other seals can be used to seal the abutments. To then fix the cover 72, the lock nut 74 is slid over the basepipe 52 and then threaded to the attachment ring 75. To complete the fixture, one or more lock fasteners 78 or the like can thread through the lock nut 74 and into the attachment ring 75.

Now that the joint 50 is manufactured, it can be handled, shipped, and stored as needed. At any point during post-manufacture and even in the field, operators can configure the joint 50 to accept tracer material. To do this, operators can remove the lock nut 74 from the attachment ring 75, first removing any fasteners 78 and then unthreading the nut 74. The cover 72 can then slide away from the end ring 76 with the cover's inner dimension 73 passing over the attachment ring 75. At this point, access to the space S inside the shroud 80 can be obtained through the one or more slots 77 in the end ring 76.

Operators then insert the desired tracer elements T into the space S. With the tracer elements T installed, operators then reassemble the access device 70 so the joint 50 can be deployed downhole. Repeating assembly steps, operators slip the cover 72 to abut between the end ring 76 and the attachment ring 75 and then affix the lock nut 74 and fasteners 78. As can be seen, the disclosed access device 70 allows operators to insert tracer elements T adjacent the screen of the jacket 60 in the field or during post manufacture without having to install the elements T during the manufacture process.

Figure 6B:
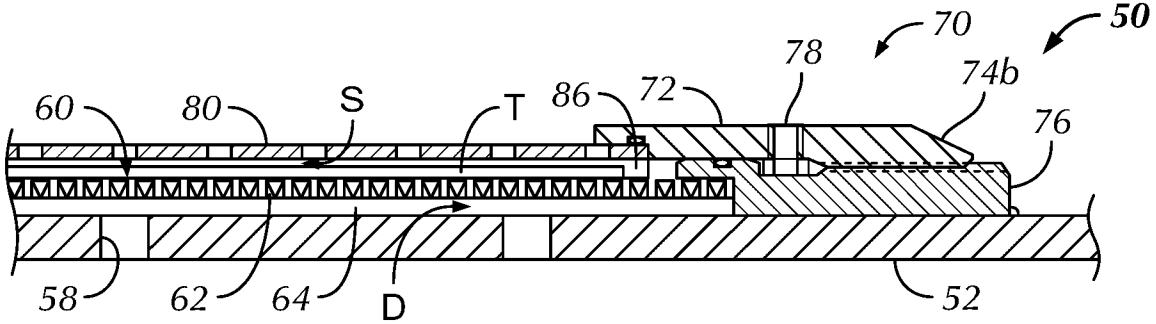
FIG. 6B-6D illustrate other wellscreens of the present disclosure having the shroud for installing tracer material in the field or post-manufacture.

In another example shown in FIG. 6B, a wellscreen joint 50 allows tracer elements T to be installed during post-manufacture or in the field between an outer shroud 80 and the screen jacket 60. The jacket 60 can be a mesh or wire-wrapped screen as noted previously, but any other filter can be used. In any event, the jacket 60 is assembled on the basepipe 52 as before.

An end ring 76 shrink fits partially over an end of the jacket 60 and is welded to the basepipe 52. At this point, the access device 70 can be assembled. The disclosed shroud 80 with spacers 86 is installed around the outside of the jacket 60. As can be seen, the internal dimension of the shroud 80 can be greater than the outer dimension of the end ring 76 so that the shroud 80 can slide over the end ring 76. As an alternative, the shroud 80 may be manufactured on the outside of the jacket 60 by circumferentially wrapping plate metal and welding along its seam(s).

With these components installed, an end ring cover 72 installs on the end ring 76 and abuts against the shroud 80 and encloses the space S for the tracer elements T. O-rings or other seals can be used to seal the abutments. The end ring cover 72 affixes to the end ring 76 using threading 74*b*, for example, and fasteners 78 in a manner similar to the lock nuts discussed previously.

Because the joint 50 is manufactured, it can be handled, shipped, and stored as needed. At any point during post-manufacture and even in the field, operators can configure the joint 50 to accept tracer material. To do this, operators can remove the end ring cover 72, first removing the fasteners 78 and then unthreading the cover 72 from the end ring 76. At this point, access to the space S inside the shroud 80 can be obtained.

Operators then insert the desired tracer elements T into the space S. With the tracer elements T installed, operators then reassemble the access device 70 so the joint 50 can be deployed downhole. As can be seen, the disclosed access device 70 allows operators to insert tracer elements T adjacent the screen joint 60 in the field or during post manufacture without having to install the elements T during the manufacture process.

Figure 6C:
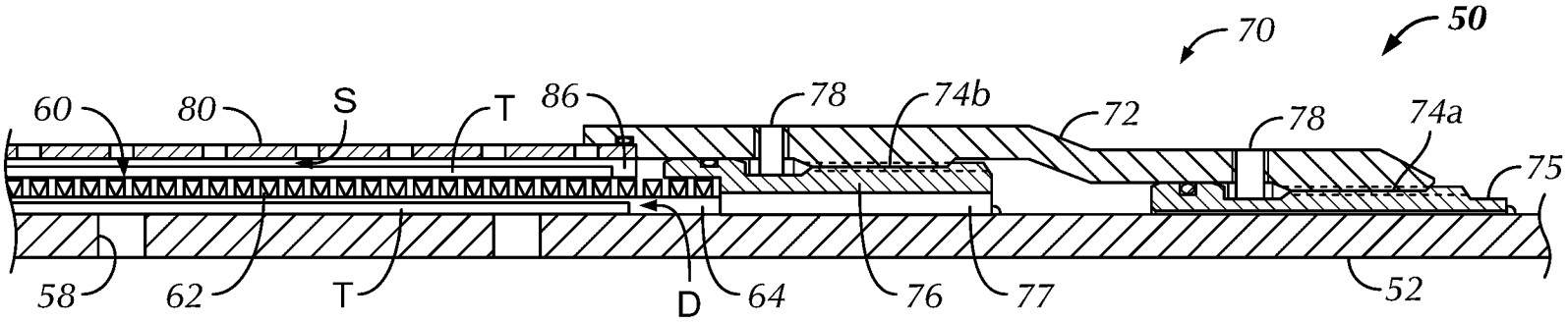

FIG. 6C shows an example of the access device 70 providing access to both the drainage layer D of the jacket 60 and the space S of a shroud 80. The end ring 76 affixes the jacket 60 in a manner similar to the embodiment of FIG. 6B, and the cover 72 has threads 74*b* that thread onto the end ring 76 to hold the shroud 80 and provide access to its space S. Additional access to the drainage layer D for placement of tracer elements T can be made through one or more slots 77 in the end ring 76. The cover 72 has a lock nut end 74*a* that threads onto an attachment ring 75 affixed to the basepipe 52.

The arrangement of FIG. 6C allows for more tracer material to be placed adjacent the jacket 60 by providing both the shroud's space S and the drainage layer D. Also, if desired for an implementation, a full set of one type of tracer material can be used for the elements T in the space S, while a full set of a different type of tracer material can be used for the elements in the drainage layer D. These different types of elements T may respond to different types of fluid so that operators can make multiple determinations about produced fluids and the like.

Figure 6D:
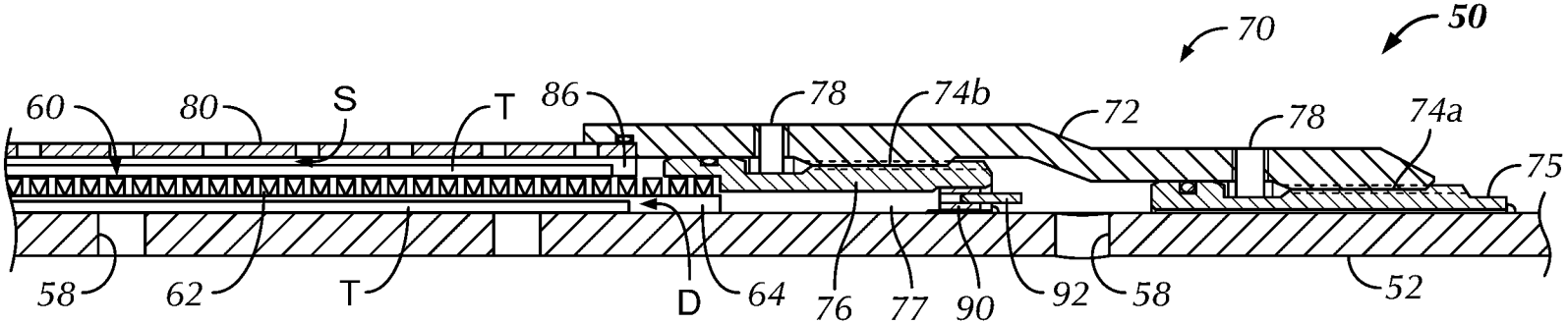

Finally, FIG. 6D shows an example of the access device 70 providing access to the space S of a shroud 80, but also acting as an inflow control device. The end ring 76 affixes the jacket 60 in a manner similar to the embodiment of FIGS. 6B-6C, and the cover 72 has threads 74*b* that thread onto the end ring 76 to hold the shroud 80 and provide access to its space S. The cover 72 also has a lock nut end 74*a* that threads onto an attachment ring 75 affixed to the basepipe 52.

The end ring 76 includes one or more slots 77 in which one or more configurable nozzles 90 are disposed. Screened fluid from the drainage layer D can pass through any of the open configurable nozzles 90 (i.e., those lacking a plug 92) to experience a pressure drop before passing into one or more perforations 58 in the basepipe 52 under the device 70. Operators can configure the joint 50 to hold tracer elements T in the space S of the shroud 80 and configure the nozzles 90 by removing and then replacing the cover 72. It may be further possible to insert tracer elements T if desired in the drainage layer by removing and replacing the restrictive nozzles 90 in the end ring's slots 77.

Given that the embodiment of the end ring 76 in FIG. 6D includes nozzles 90 in the slots 77 and can provide access to the drainage layer for insertion of tracer element T, it will be appreciated that the end rings 76 for the embodiments of FIGS. 2C, 3, and 4 could also include such nozzles 90.

Figure 7A:
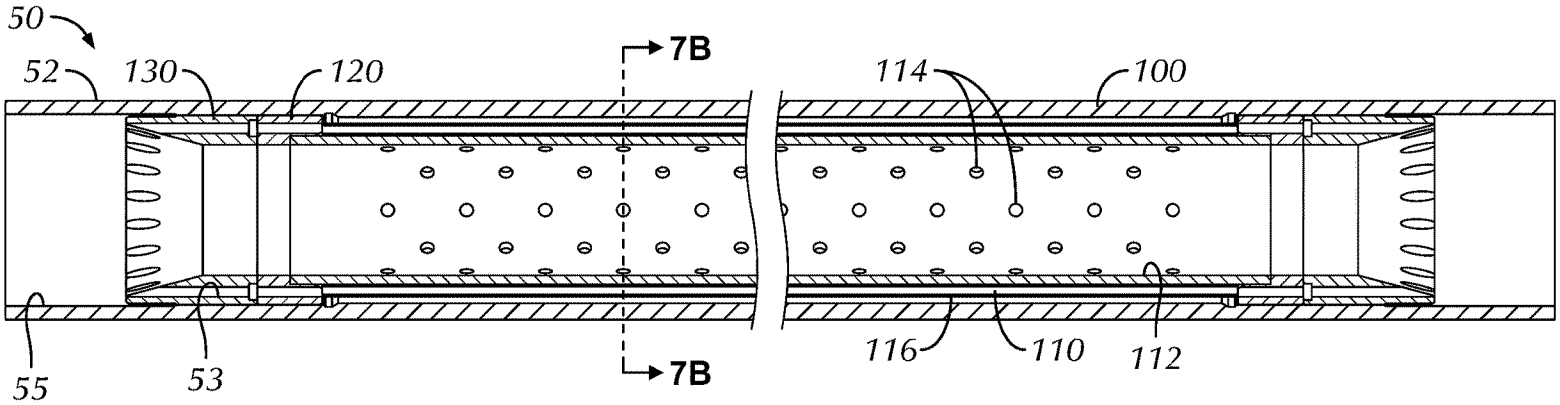
FIGS. 7A-7B illustrate cross-sectional and end-sectional views of an internal carrier for holding chemical tracer disposed inside a basepipe.
Figure 7B:
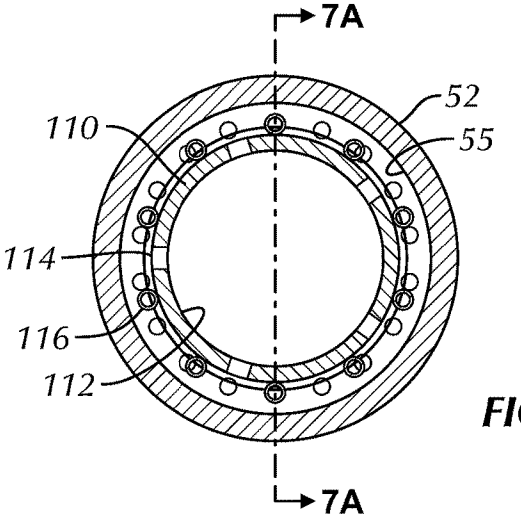

FIGS. 7A-7B illustrate cross-sectional and end-sectional views of an internal carrier 100 for holding chemical tracer disposed inside a joint 50 having a basepipe 52, which can be casing or other tubing. In this arrangement, the basepipe 52 may not define perforations and may not have a wellscreen. The internal carrier 100 positions in the through-bore 55 of the basepipe 52 and includes a shroud 110 affixed by retainers 120, 130 at both ends in the bore 55.

Figure 8:
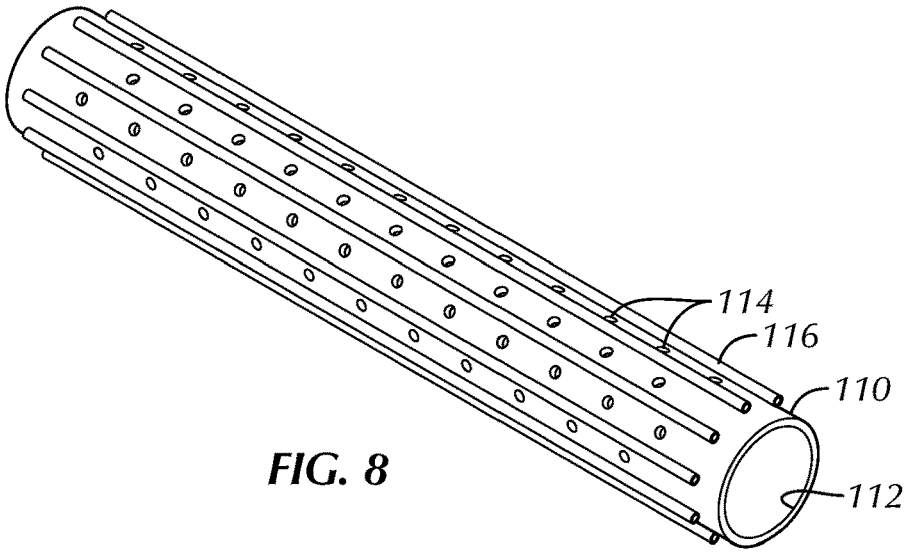
FIG. 8 illustrates a perspective view of a shroud and spacers for the disclosed carrier.

The shroud 110, which is shown in a perspective view of FIG. 8, is a cylindrical pipe or tube having an internal passage 112 and perforations 114. In an alternative arrangement, the shroud 110 can be wire-wrapped screen or other permeable fixture. The flow area provided by the perforations 114 or the like can be configured for a particular implementation.

When disposed in the basepipe's bore 55, the shroud's passage 112 completes the fluid passageway through the basepipe 52, albeit with a reduced dimension in some cases. A number of spacers 116 can be affixed about the circumference of the shroud 110 to make a number of separate pockets or gaps for holding tracer elements. The spacers 116 can have any particular shape and are shown as hollow tubes in the current example. In general, the spacers 116 can be tubes, rods, other shapes that are readily available and are stitch welded on the inner shroud 110, making it cost effective for manufacture.

Figure 9A:
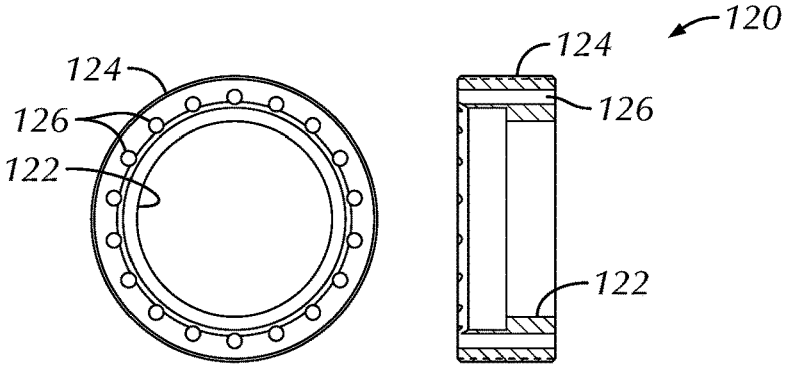
FIG. 9A shows an end view and a cross-sectional view of one retainer for the end of the disclosed carrier.
Figure 9B:
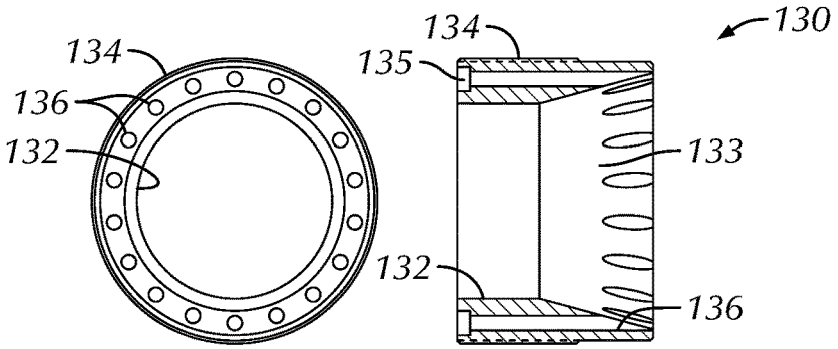
FIG. 9B shows an end view and a cross-sectional view of another retainer for the end of the disclosed carrier.
Figure 10A:
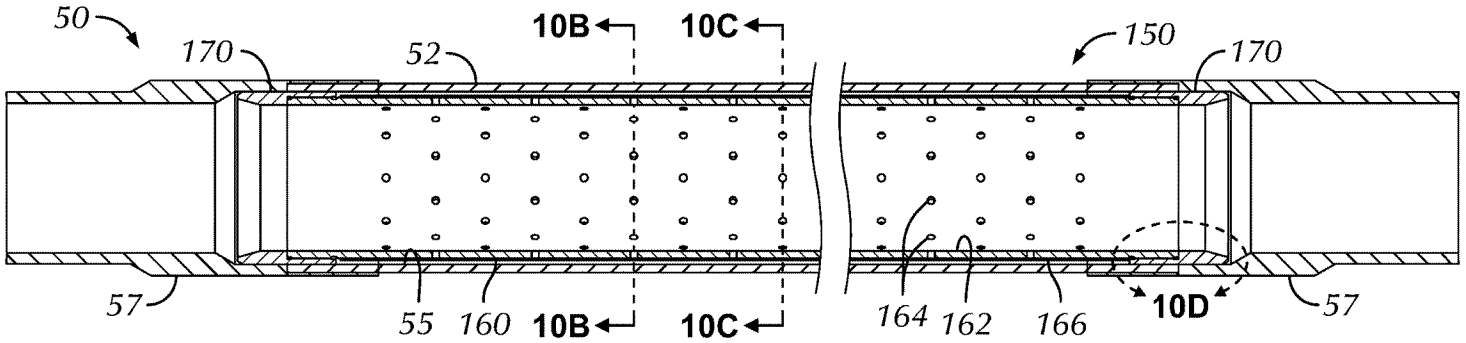
FIGS. 10A-10D illustrate a cross-sectional view, two end-sectional views, and a detailed view of another internal carrier for holding chemical tracer disposed inside a basepipe.
Figure 10D:
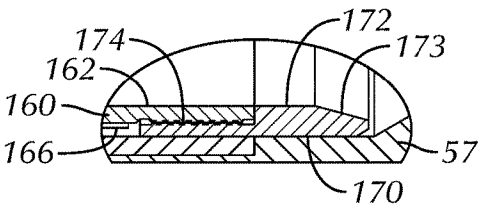
Figure 10C:
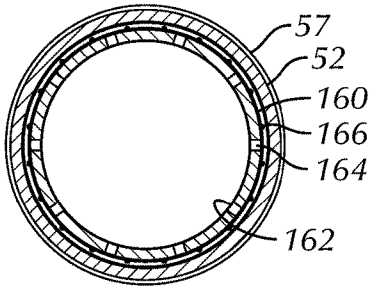
Figure 10B:
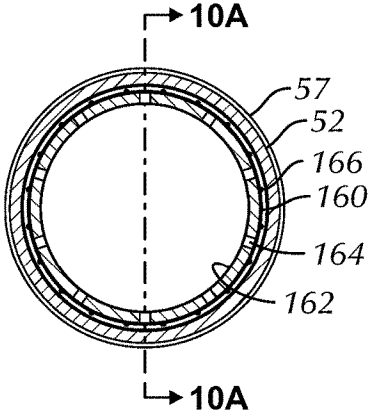

To hold the shroud 110 inside the basepipe's bore 55, one or more retainers 120, 130 at both ends of the shroud 110 engage the shroud 110 and affix to the bore 55. Two retainers 120, 130 are used at both ends to facilitate assembly, but other implementations may use a different arrangement of retainers. The two retainers 120, 130 include a spacing retainer 120, which is shown in an end view and a cross-sectional view in FIG. 9A, and includes a transition retainer 130, which is shown in an end view and a cross-sectional view in FIG. 9B.

The spacing retainers 120 fit partially on the free-ends of the shroud 110 and include a central passage 122 to communicate with the passage 122 of the spacing retainer 120, 112 of the shroud 110, and the bore 55 of basepipe 52. Various peripheral slots 126 can be defined around the outside of the central passage 122 to communicate fluid into the annular space between the shroud 110 and pipe's bore 55. External thread 124 can be provided on the exterior of the spacing retainers 120 to thread into internal thread 53 defined in portions of the pipe's bore 55. Spacing retainer 120 has a counterbore to centralize the shroud 110 in the bore 55 of basepipe 52.

The transition retainers 130 fit against the spacing retainers 120 and include a central passage 132 to communicate with the passages 112, 122 of the shroud 110 and spacing retainers 120. Various peripheral slots 136 can be defined around the outside of the central passage 132 to communicate fluid into the annular space between the shroud 110 and pipe's bore 55. External thread 134 can be provided on the exterior of the transition retainers 130 to thread to the internal thread 53 defined in the pipe's bore 55. Preferably, the central passages 132 of these retainers 130 define a transition 133 to mate the dimension of the pipe's bore 55 with the dimension of the central passage 132. This transition 133 can be a 20-degree chamfer or the like to ease the entry of wireline tractors and other tools to be passed through the joint 50. Counter bores 135 can be defined on the inside edge of the transition retainers 130 at the peripheral slots 136 to minimize any misalignment between the peripheral slots 136 with the slots 126 of the spacing retainer 120.

Assembly of the carrier 100 with tracer elements can involve fitting retainers 120, 130 inside the pipe's bore 55 at one end. The two retainers 120, 130 thread inside the pipe's thread 53 and can be tightened against one another to lock in place. Operators can fit the shroud 110 partially in the pipe's bore 55 and can insert the tracer elements in the annular space separated by the spacers 116. Once fitted with the proper type(s) and amount(s) of tracer elements, the shroud 110 can be inserted into the pipe's bore 55 so that the shroud's free-end engages the lip of the spacing retainer 120. At this point, operators can complete the assembly by installing the other retainers 120, 130 in the pipe's bore 55 at the other end of the shroud 110 to hold it in place.

When the basepipe 52 with the carrier 110 is installed downhole, fluid flow through the basepipe 52 can activate the tracer elements carried in the annular space around the shroud 110. Fluid flow into the annular space can be facilitated by the peripheral slots 126, 136 in the retainers 120, 130. Chemical tracer entrained in the flow can enter the main flow through the basepipe 52 via the perforations 114 in the shroud 110. In an alternate scenario, the fluid flow into the annular space is facilitated by the perforations 114, and the chemical tracer entrained in the flow can exit through the peripheral slots 126, 136 in the retainers 120, 130. In the disclosed embodiment, the modular structure of the carrier 100 facilitates easy assembly and can help when maintenance is required.

FIGS. 10A-10D illustrate a cross-sectional view, two end-sectional views, and a detailed view of another internal carrier 150 for holding chemical tracer disposed inside a joint 50 having a basepipe 52, which can be casing or other tubing. Again in this arrangement, the basepipe 52 may not define perforations and may not have a wellscreen. The internal carrier 150 positions in the through-bore 55 of the basepipe 52 and includes a shroud 160 affixed by retainers 170 at both ends in the bore 55.

Figure 11:
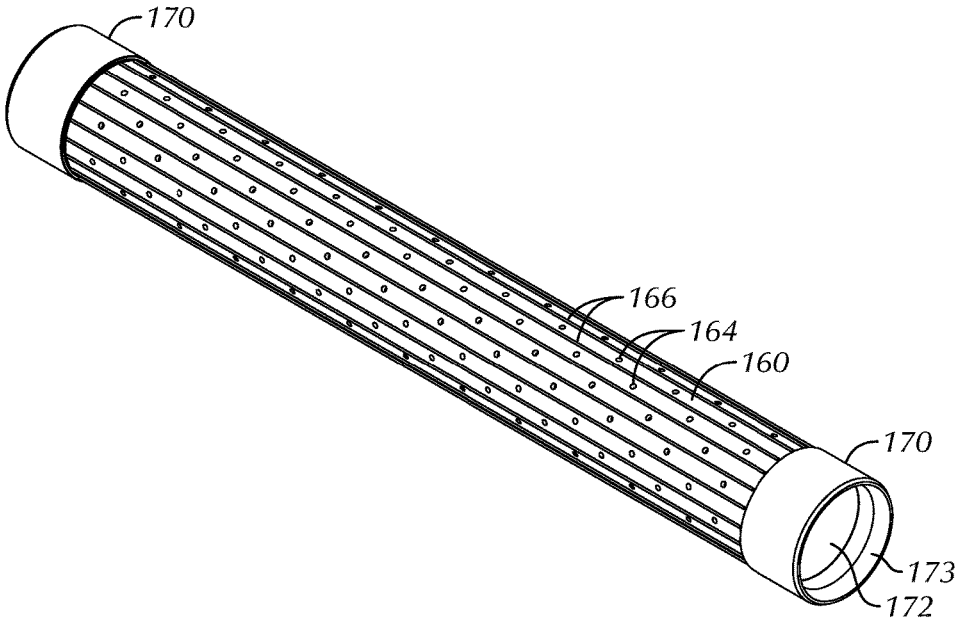
FIG. 11 illustrates a perspective view of a shroud, spacers, and end retainers for the disclosed carrier.

The shroud 160, which is shown in a perspective view of FIG. 11, is a cylindrical pipe or tube having an internal passage 162 and perforations 164. In an alternative arrangement, the shroud 160 can be wire-wrapped screen or other permeable fixture. Again, the flow area provided by the perforations 164 or the like can be configured for a particular implementation.

When disposed in the basepipe's bore 55, the shroud's passage 162 completes the fluid passageway through the basepipe 52. A number of spacers 166 can be affixed about the circumference of the shroud 160 to make a number of separate pockets or gaps for holding tracer elements. The spacers 166 can have any particular shape and are shown as solid wire in the current example. In general, the spacers 166 can be tubes, rods, other shapes that are readily available and stitch welded on the inner shroud 160, making it cost effective for manufacture.

To hold the shroud 160 inside the basepipe's bore 55, retainers 170 at both ends of the shroud 160 engage the shroud 160 and affix it in the bore 55. The retainers 170, shown in detail in FIG. 10D, have a threaded lip 174 to thread on ends of the shroud 160. A central passage 172 of the retainers 170 complete the shroud's internal passage 162. A transition 173 may be provided on the outer edge of the retainer 170. In any event, the dimension of the shroud's passage 162 and the retainer's passage 172 are configured to match the dimension of the pipe's bore 55 so that restriction through the basepipe 52 is minimized. In another variation, slots (not shown) on the outer periphery of the retainer 170 can facilitate the flow of fluids.

The retainers 170 fit on the ends of the shroud 160 and hold it axially in the basepipe 52 between crossovers or couplings 57 that affix on both ends of the basepipe 52. The crossover or couplings 57 can have a box end that threads to a pin end of the basepipe 52. The couplings 57 can also have a pin or box end for affixing to other components of an assembly. In an alternate arrangement depending on their dimensional constraints, the basepipe 52 can have a box end, and the crossover or couplings 57 can have a pin end.

Assembly of the carrier 150 with tracer elements can involve fitting a retainer 170 on a far end of the shroud 160 and fitting a crossover or coupling 57 on the far end of the basepipe 52. The shroud 160 can fit partially inside the pipe's bore 55 at the near end. Operators can insert the proper type(s) and amount(s) of tracer elements in the annular space separated by the spacers 166. The other retainer 170 can affix to the near end of the shroud 160, and the shroud 160 can be inserted into the pipe's bore 55 so that the shroud's retainer 170 engages the inner shoulder of the far crossover or coupling 57. At this point, operators can complete the assembly by installing the near crossover or coupling 57 at the near end of basepipe 52 to hold the shroud 160 in place.

When the basepipe 52 with the carrier 160 is installed downhole, fluid flow through the basepipe 52 can activate the tracer elements carried in the annular space around the shroud 160. Chemical tracer entrained in the flow can enter the main flow through the basepipe 52 via the perforations 164 in the shroud 160. In an alternate scenario, the fluid flow into the annular space is facilitated by the perforations 164 in the shroud 160, and chemical tracer entrained in the flow can exit through the annular space around the shroud 160. Overall, the modular structure of the carrier 160 facilitates easy assembly and can help when maintenance is required.

In the above arrangements of FIGS. 2A-6B, tracer elements are disposed external to a basepipe allowing for wetting of fluid flow from the borehole annulus to the tubing string with tracer. It will be appreciated that the arrangements of FIGS. 2A-6B can be used with basepipes 52 lacking perforations. This would equate to an annular wetting arrangement where the tracer elements wet the flow of fluid in the borehole annulus without passing into the basepipe 52. The fluid could pass into a tubing string elsewhere in an assembly.

In the above arrangements of FIGS. 7A-11, the internal carriers 100, 150 have been used inside basepipes 50 lacking perforations and wellscreens. This equates to a tubing wetting arrangement for entraining tracer in fluid passing through a tubing string. It will be appreciated that each of the internal carriers 100, 150 can be used in other implementations, including those having basepipe's with perforations and those having perforations and wellscreens.

Figure 12A:
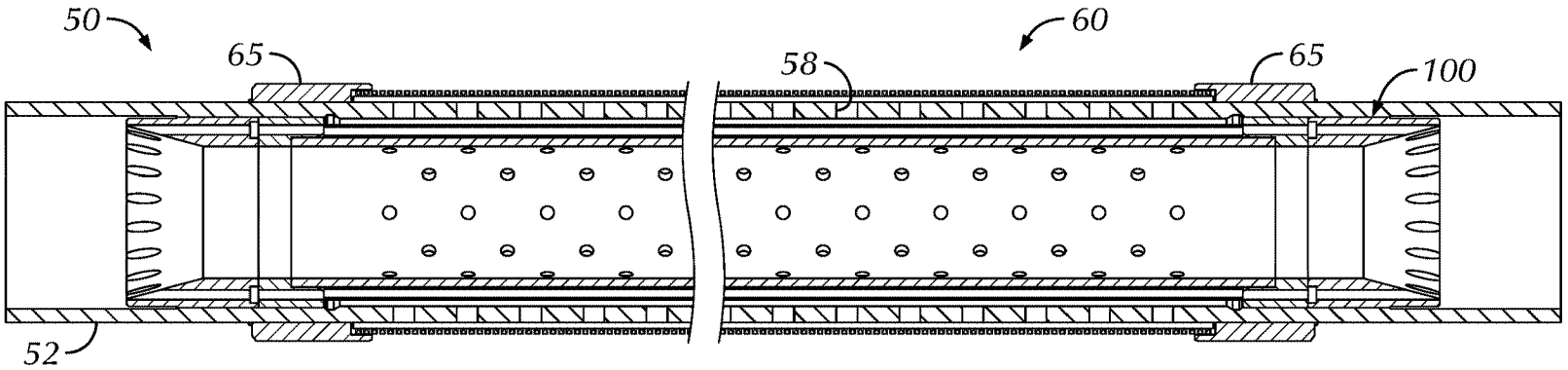
FIG. 12A illustrates a cross-sectional view of the internal carrier of FIG. 7A used in a basepipe having a wellscreen.
Figure 12B:
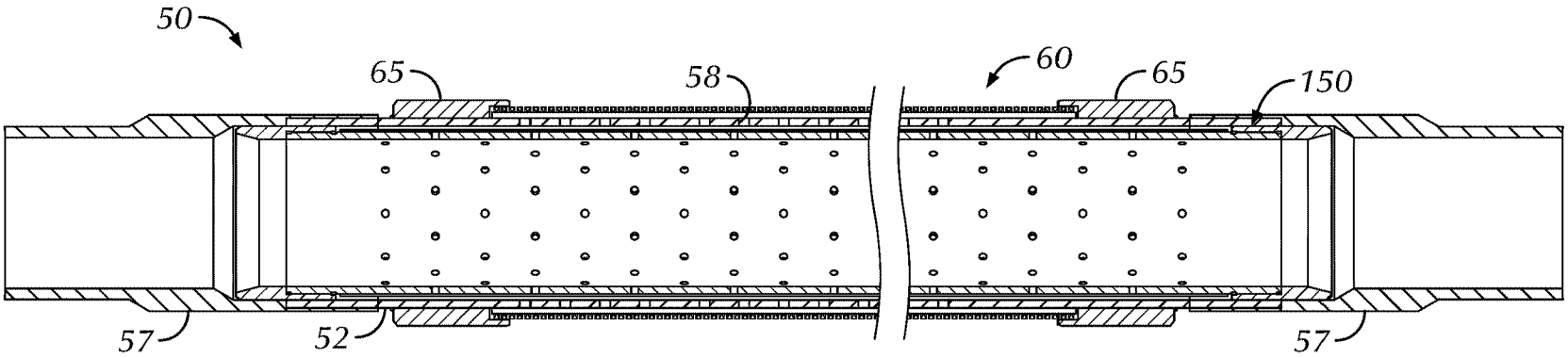
FIG. 12B illustrates a cross-sectional view of the internal carrier of FIG. 10A used in a basepipe having a wellscreen.

Accordingly, a combined wetting arrangement can be used in which both annular and tubing wetting of the fluid flow can be achieved. For example, FIG. 12A illustrates a cross-sectional view of the internal carrier 100 of FIG. 7A used in a basepipe 52 having perforations 58. As another example, FIG. 12B illustrates a cross-sectional view of the internal carrier 150 of FIG. 10A used in a basepipe 52 having perforations 58. In both of these examples, the basepipe 52 can have a wellscreen or jacket 60 disposed external to the perforations 58 and secured to the basepipe 52 with end rings 65 or the like. The end ring 65 can be welded or wire-locked in place.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter. For example, a screen as in FIGS. 2A-2B can have an access device 70 on both ends instead of just one. In another example, one end of the internal shroud can have a retainer ring as in FIG. 7A on one end and can be held by a coupling as in FIG. 10A. In other examples, any over the various access devices, shrouds, screens, end rings, attachment rings, covers, cover rings, and the like can be combined to increase or decrease space and access available for trace material.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole assembly positioning in a borehole for dispensing tracer material, the assembly comprising:

a basepipe having first and second ends and defining a first through-bore, the basepipe comprising first and second internal threads defined in the first through-bore;

an internal shroud having third and fourth ends and defining a second through-bore, the internal shroud disposed inside the first through-bore of the basepipe and defining an annular space therewith, the internal shroud holding the tracer material in the annular space and permitting fluid communication between the annular space and at least one of the first and second through-bores; and fixtures disposed on the third and fourth ends of the internal shroud and holding the internal shroud in the first through-bore, the fixtures comprising retainer rings engaged on the third and fourth ends of the internal shroud and each having external thread threaded with a respective one of the first and second internal threads.

2. The assembly of claim 1, wherein each of the retainer rings defines a central passage permitting fluid communication between the first and second through-bores.

3. The assembly of claim 2, wherein the central passages of the retainer rings each defines a transition from a larger diameter of the first through-bore to a smaller diameter of the second through-bore.

4. The assembly of claim 1, wherein the basepipe defines one or more first perforations communicating between the first through-bore and the borehole; wherein the internal shroud defines one or more second perforations communicating the second through-bore with the annular space: and/or wherein the retainer rings define peripheral passages permitting fluid communication between the first through-bore and the annular space.

5. The assembly of claim 1, further comprising a filter disposed outside the basepipe adjacent the one or more perforations, the one or more perforations defined in the basepipe and communicating with the annular space.

6. The assembly of claim 1, wherein the retainer rings each define an internal shoulder supporting a respective one of the third and fourth ends of the internal shroud and forming the annular space between the first through-bore and the internal shroud.

7. The assembly of claim 1, wherein the internal shroud comprises a plurality of spacers disposed externally thereabout and dividing the annular space into a plurality of subdivisions.

8. A downhole assembly positioning in a borehole for dispensing tracer material, the assembly comprising:

a basepipe having first and second ends and defining a first through-bore;

an internal shroud having third and fourth ends and defining a second through-bore, the shroud disposed inside the first through-bore of the basepipe and defining an annular space therewith, the internal shroud holding the tracer material in the annular space and permitting fluid communication between the annular space and at least one of the first and second through-bores; and fixtures disposed on the third and fourth ends of the internal shroud and holding the internal shroud in the first through-bore, the fixtures comprising:

retainer rings attached to the third and fourth ends of the internal shroud and forming the annular space between the internal shroud and first through-bore of the basepipe, and couplings affixed on the first and second ends of the basepipe for connecting sections of the basepipe together, the couplings each defining an intemal shoulder engaging a respective one of retainer rings on the third and fourth ends of the internal shroud and holding the internal shroud inside the first through-bore.

9. The assembly of claim 8, wherein the basepipe defines one or more first perforations communicating between the first through-bore and the borehole; wherein the internal shroud defines one or more second perforations communicating the second through-bore with the annular space; and/or wherein the retainer rings define peripheral passages permitting fluid communication between the first through-bore and the annular space.

10. The assembly of claim 8, wherein the internal shroud comprises a plurality of spacers disposed externally thereabout and dividing the annular space into a plurality of subdivisions.

11. The assembly of claim 8, wherein the retainer rings each define an internal shoulder supporting a respective one of the third and fourth ends of the internal shroud and forming the annular space between the first through-bore and the internal shroud.

12. A method of installing tracer material on a basepipe for use downhole, the basepipe having first and second ends and defining a first through-bore, the method comprising not necessarily in sequence:

positioning an internal shroud inside the first through-bore of the basepipe, the internal shroud having third and fourth ends and defining a second through-bore, the internal shroud defining an annular space with the first through-bore of the basepipe;

positioning the tracer material in the annular space between the first through-bore and the internal shroud; and holding the tracer material in the annular space and permitting fluid communication between the annular space and at least one of the first and second through-bores by engaging at least one retaining ring on a respective one of the third and fourth ends of the internal shroud and threading external thread on the at least one retaining ring with at least one internal thread defined in the first through-bore of the basepipe.

13. The method of claim 12, further comprising permitting fluid communication with the annular space through at least one of: (i) one or more first perforations defined in the basepipe, (ii) peripheral passages defined in the retainer rings, and (iii) one or more second perforations defined in the internal shroud.

14. The method of claim 12, further comprising installing a filter outside the basepipe adjacent one or more perforations, the one or more perforations defined in the basepipe and communicating with the annular space.

15. The method of claim 12, wherein positioning the tracer material in the annular space between the first through-bore and the internal shroud comprises arranging the tracer material about divisions of the annular space disposed about the internal shroud.

16. The method of claim 12, comprising engaging first and second of the at least one retaining ring respectively on the third and fourth ends of the internal shroud and threading the external threads on the first and second retaining rings respectively with first and second of the at least one internal thread defined in the first through-bore of the basepipe.

17. The method of claim 12, comprising attaching a second of the at least one retaining ring on the other of the third and fourth ends of the internal shroud, affixing a coupling on a respective one the first and second ends of the basepipe, and engaging an internal shoulder of the coupling on the second retainer ring.

18. A method of installing tracer material on a basepipe for use downhole, the basepipe having first and second ends and defining a first through-bore, the method comprising not necessarily in sequence:

positioning an internal shroud inside the first through-bore of the basepipe, the internal shroud having third and fourth ends and defining a second through-bore, the internal shroud defining an annular space with the first through-bore of the basepipe;

positioning the tracer material in the annular space between the first through-bore and the internal shroud; and holding the tracer material in the annular space and permitting fluid communication between the annular space and at least one of the first and second through-bores by attaching at least one retaining ring on one of the third and fourth ends of the internal shroud, affixing at least one coupling on a respective one the first and second ends of the basepipe, and engaging an internal shoulder of the at least one coupling on the at least one retainer ring.

19. The method of claim 18, further comprising permitting fluid communication with the annular space through at least one of: (i) one or more first perforations defined in the basepipe, (ii) peripheral passages defined in the retainer rings, and (iii) one or more second perforations defined in the internal shroud.

20. The method of claim 18, wherein positioning the tracer material in the annular space between the first through-bore and the internal shroud comprises arranging the tracer material about divisions of the annular space disposed about the internal shroud.

* * * * *